United States Patent [19]

Irie et al.

[11] Patent Number: 4,623,137

[45] Date of Patent: Nov. 18, 1986

[54] PAPER FEEDER EQUIPPED WITH COYPING PAPER CASSETTES

[75] Inventors: Yoichiro Irie, Suita; Hiroshi Kimura, Habikino; Masahiko Hisajima; Kiyoshi Shibata, both of Osaka; Yasuhiko Yoshikawa, Ikoma, all of Japan

[73] Assignee: Mita Industrial Co., Ltd., Osaka, Japan

[21] Appl. No.: 534,620

[22] Filed: Sep. 22, 1983

[30] Foreign Application Priority Data

Sep. 28, 1982 [JP] Japan ..... 57-167600

[51] Int. Cl.[4] ..... B65H 1/24

[52] U.S. Cl. ..... 271/160; 271/127; 271/164; 271/171

[58] Field of Search ..... 271/22, 126, 127, 160, 271/162, 164, 170, 171

[56] References Cited

U.S. PATENT DOCUMENTS

| | | | |
|---|---|---|---|
| 3,768,805 | 10/1973 | Kuksa | 271/126 |
| 4,007,925 | 2/1977 | De Ryke et al. | 271/126 |
| 4,009,957 | 3/1977 | Suzuki et al. | 355/14 SH |
| 4,307,878 | 12/1981 | Kono | 271/160 |
| 4,343,461 | 8/1982 | Tomimori et al. | 271/160 |
| 4,509,738 | 4/1985 | Aoki | 271/127 |

FOREIGN PATENT DOCUMENTS

| | | | |
|---|---|---|---|
| 52-82237 | 7/1977 | Japan . | |
| 0037937 | 4/1981 | Japan | 271/121 |

*Primary Examiner*—Bruce H. Stoner, Jr.
*Assistant Examiner*—James E. Barlow
*Attorney, Agent, or Firm*—Wenderoth, Lind & Ponack

[57] ABSTRACT

A paper feeder equipped with copying paper cassettes comprises a cassette-receiving section within the housing of a copying apparatus for mounting thereon a plurality of copying paper cassettes containing sheets of copying paper having different sizes. Each of the paper cassettes includes a main body for holding paper sheets which has an opening formed at the forward end portion of its bottom wall and a bottom plate for placing paper sheets thereon which is mounted on the bottom wall of the main body of the cassette so that it can freely pivot about its rear end portion as a fulcrum. The housing of the coyping apparatus has provided therein a press-contacting mechanism adapted to act on the bottom plate of the cassette through the opening in the main cassette body. The bottom plate of at least that paper cassete which contains sheets of copying paper having a relatively large size has a compensation piece formed therein so that the press-contacting pressure under which the uppermost paper sheet of the sheets of paper having a relatively large size is kept in press contact with a paper feeding member provided in the cassette-receiving section becomes substantially equal to the press-contacting pressure under which the uppermost paper sheet of the sheets of copying paper having a relatively small size is kept in press contact with the paper feeding member.

5 Claims, 12 Drawing Figures

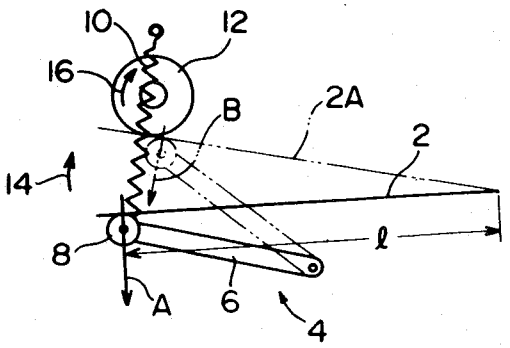
PRIOR ART
FIG. 1
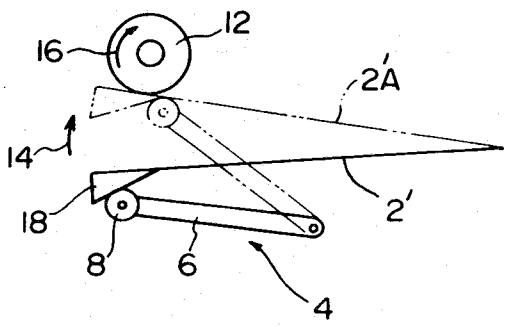
FIG. 3
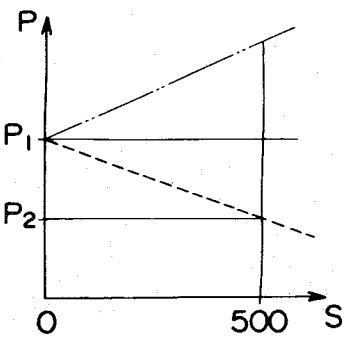
FIG. 2-A
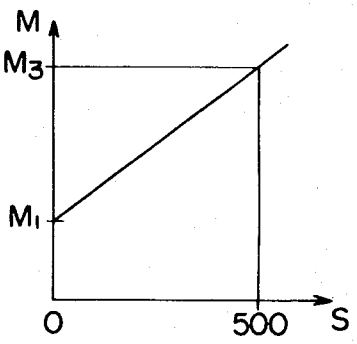
FIG. 2-B
FIG. 2-C

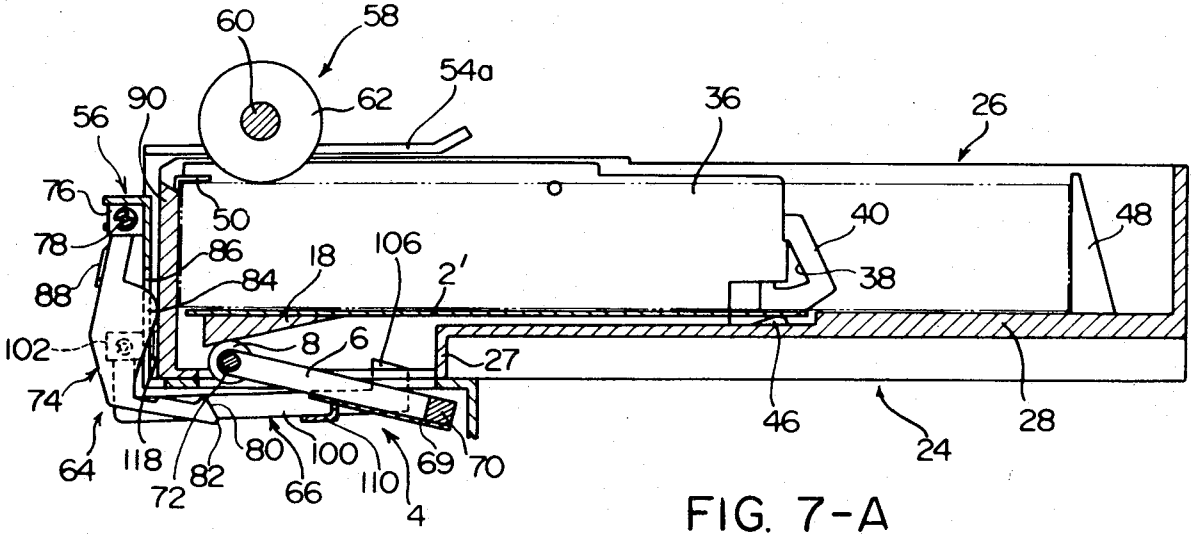
FIG. 7-A
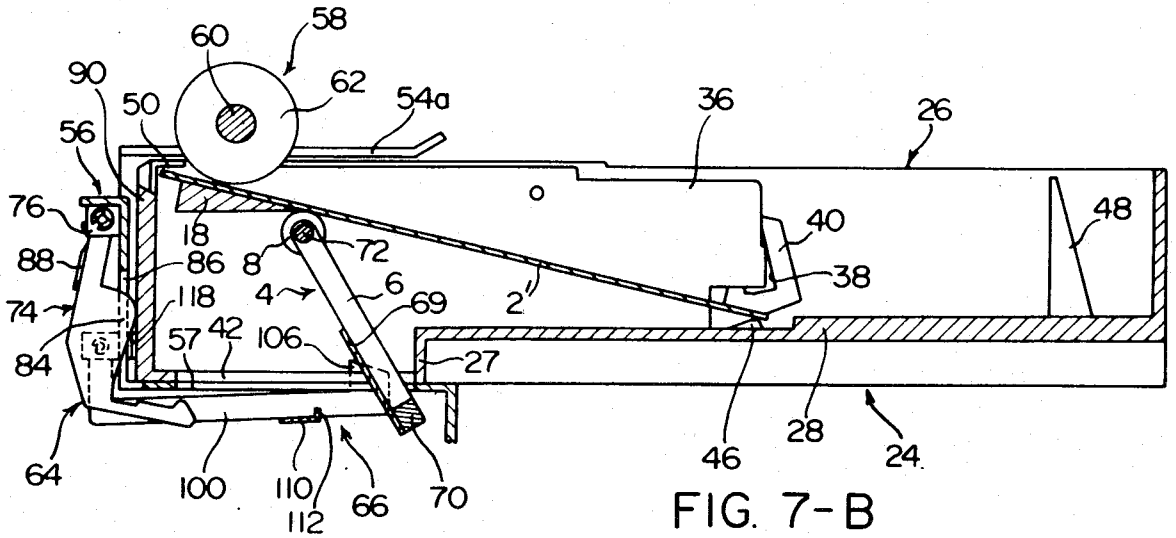
FIG. 7-B

PAPER FEEDER EQUIPPED WITH COPYING PAPER CASSETTES

FIELD OF THE INVENTION

This invention relates to a paper feeder equipped with copying paper cassettes.

DESCRIPTION OF THE PRIOR ART

In a direct-type (EF-type) electrostatic copying apparatus or a transfer-type (PPC-type) electrostatic copying apparatus, it is necessary to feed a copying paper (a photosensitive paper or receptor paper) through a predetermined paper conveying passage defined within the housing of the copying apparatus. In recent years, a paper feeder equipped with a paper cassette for holding sheets of copying paper cut to a predetermined size has come into practical use. Such a paper feeder generally includes a cassette-receiving section disposed within the housing of a copying apparatus, and a paper cassette mounted on the cassette-receiving section. The paper cassette has a main body for holding sheets of copying paper which has an opening formed at the forward end portion of its bottom wall and a bottom plate for placing sheets of copying paper thereon which is mounted on the bottom wall of the main body in such a way that it can freely pivot about its rear end portion as a fulcrum. On the other hand, a press-contacting mechanism adapted to act on the bottom plate of the cassette through the opening in the main body of the cassette is provided in the housing of the copying apparatus. When the paper cassette is mounted on the cassette-receiving section and the press-contacting mechanism is put in condition for acting on the bottom plate of the cassette, the sheets of copying paper are maintained in a feedable state in which the uppermost paper sheet is elastically kept in press contact with a paper feeding member provided in the cassette-receiving section.

As copying apparatus are reduced in size and simplified in construction, this type of paper feeder is constructed such that paper cassettes containing sheets of copying paper having different sizes (and hence different weights according to sizes) can be mounted on the cassette-receiving section.

The paper feeder equipped with paper cassettes as described above has the following defect or inconvenience. The bottom plate of the cassette having paper sheets placed thereon is caused to pivot about its rear end as a fulcrum so that the uppermost paper sheet is elastically kept in press contact with the paper feeding member by the press-contacting mechanism (for example, a lever member capable of being elastically biased by a spring member). Thus, when the size (and hence, the weight in relation to the size) of the paper sheets placed on the bottom plate of the cassette differs, the pressure under which the uppermost paper sheet is elastically kept in press contact with the paper feeding member changes. The difference in press-contacting pressure, therefore, makes it difficult to feed paper sheets accurately one by one.

SUMMARY OF THE INVENTION

It is a primary object of this invention therefore to provide an improved paper feeder equipped with copying paper cassettes, in which the aforesaid press-contacting pressure can be maintained substantially equal irrespective of the sizes of copying paper sheets.

According to this invention, there is provided a paper feeder equipped with copying paper cassettes comprising a cassette-receiving section within the housing of a copying apparatus for mounting thereon a plurality of copying paper cassettes containing sheets of copying paper having different sizes, wherein each of said paper cassettes includes a main body for holding paper sheets which has an opening formed at the forward end portion of its bottom wall and a bottom plate for placing paper sheets thereon which is mounted on the bottom wall of the main body of the cassette so that it can freely pivot about its rear end portion as a fulcrum. The housing of the copying apparatus has provided therein a press-contacting mechanism adapted to act on the bottom plate of the cassette through the opening in the main cassette body, and when the press-contacting mechanism is in condition for acting on the bottom plate of the cassette, the paper sheets contained in the main body of the cassette are maintained in a feedable state in which the uppermost paper sheet is elastically kept in press contact with a paper feeding member provided in the cassette-receiving section. The bottom plate of at least that paper cassette which contains sheets of copying paper having a relatively large size has a compensation piece formed therein so that in said paper feedable state, the press-contacting pressure under which the uppermost paper sheet of the sheets of copying paper having a relatively large size is kept in press contact with the paper feeding member becomes substantially equal to the press-contacting pressure under which the uppermost paper sheet of the sheets of copying paper having a relatively small size is kept in press contact with the paper feeding member.

BRIEF DESCRIPTION OF THE DRAWINGS

FIG. 1 is a schematic diagram explaining the principle of a conventional paper feeder equipped with copying paper cassettes;

FIGS. 2-A, 2-B and 2-C are respectively a diagram showing the relation between the number of copying paper sheets and the moment of the copying paper when sheets of the copying paper having a relatively small size are placed on the bottom plate of a cassette, a diagram showing the relation between the number of copying paper sheets and the moment of the copying paper when sheets of the copying paper having a relatively large size are placed on the bottom plate of a cassette, and a diagram showing the relation between the number of copying paper sheets placed on the bottom plate of a cassette and the pressing force acting on the copying paper;

FIG. 3 is a diagram explaining the principle of the paper feeder equipped with copying paper cassettes which is constructed in accordance with this invention;

FIGS. 7-A and 7-B are sectional views showing the state in which the copying paper cassette shown in FIG.

Figure 4:
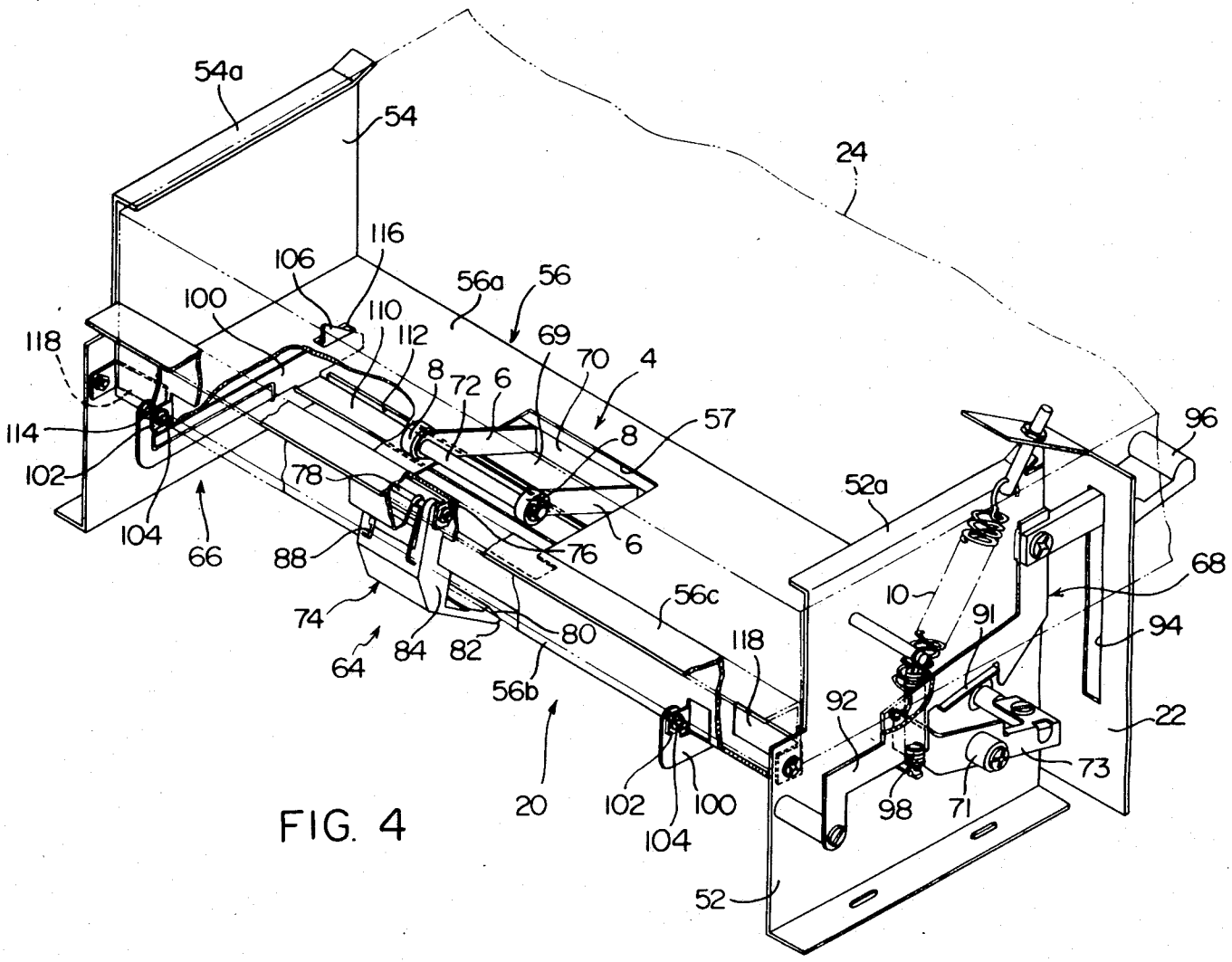
FIG. 4 is a partly broken-away perspective view showing a cassette-receiving section in a preferred embodiment of the feeder constructed in accordance with the principle of this invention.
Figure 8:
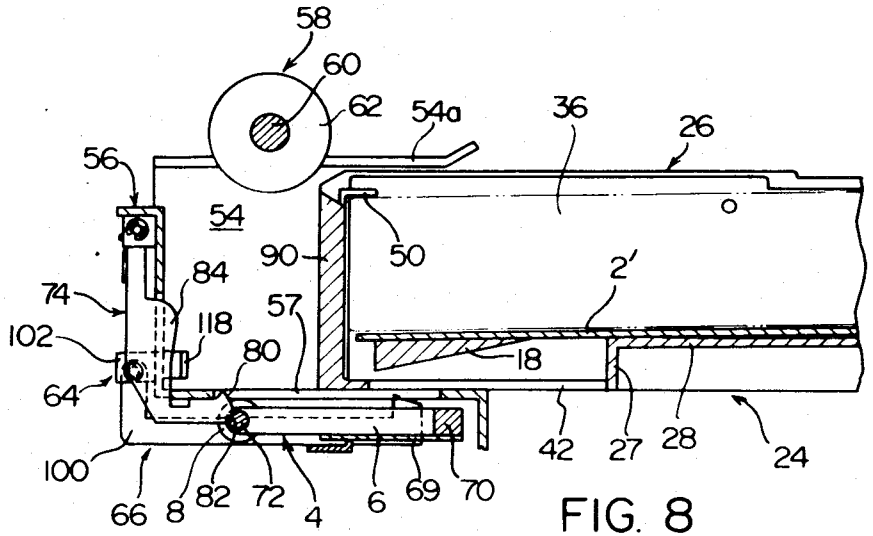
Figure 9:
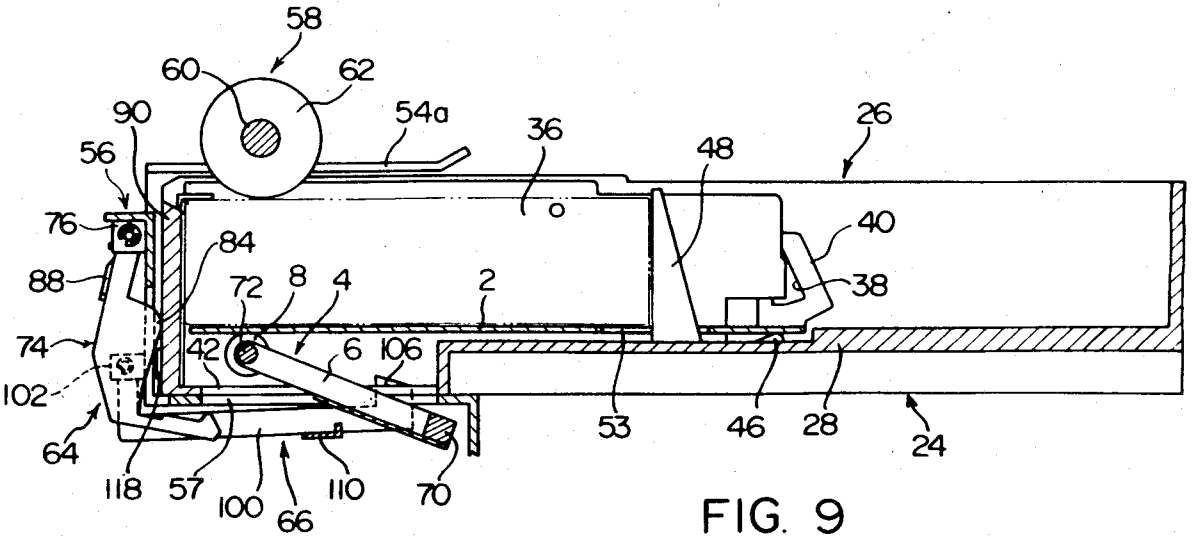

6 is mounted on the cassette-receiving section shown in FIG. 4;

FIG. 8 is a partial sectional view showing the state in which a press-contacting mechanism of the paper feeder constructed in accordance with this invention is maintained in an inoperative condition; and FIG. 9 is a sectional view showing the state in which a copying paper cassette containing sheets of copying paper having a relatively small size is mounted on the cassette-receiving section shown in FIG. 4.

DETAILED DESCRIPTION OF PREFERRED EMBODIMENTS

The principle of this invention and some preferred embodiments of the paper feeder equipped with paper cassettes which is constructed in accordance with the aforesaid principle will be described in detail with reference to the accompanying drawings.

First, the principle of this invention is described with reference to FIGS. 1 to 3.

In FIG. 1 which illustrates the outline of a conventional paper feeder, the reference numeral 2 designates a bottom plate secured to the bottom wall of a copying paper cassette (not shown), and sheets of copying paper are placed on the upper surface of the bottom plate 2. The bottom plate 2 is constructed such that its forward end portion can be elastically lifted upwardly by a press-contacting mechanism 4. The press-contacting mechanism 4 includes a lever member 6 mounted pivotably on the housing (not shown) of a copying apparatus, a roller 8 mounted rotatably on one end portion of the lever member 6 and adapted to be in abutment against the forward end portion of the bottom plate 2, and a spring member 10 having one end portion fixed to the lever member 6 and the other end portion fixed to the housing of the copying apparatus. Above the front portion of the bottom plate 2 of the cassette, a paper feed roller 12 (constituting a paper feed member) is disposed for delivering sheets of copying paper placed on the bottom plate 2 of the cassette. The paper feed roller 12 is rotatably mounted on the housing of the copying apparatus.

Hence, in the paper feeder described above, when the press-contacting mechanism 4 is in condition for acting on the bottom plate 2 of the cassette, the roller 8 is caused to abut against the bottom plate 2. As a result, by the elastic force of the spring member 10, the bottom plate 2 is caused to pivot in the direction shown by an arrow 14 about its rear end portion as a fulcrum. Thus, the sheets of copying paper placed on the bottom plate 2 are maintained in a feedable state in which the upper surface of the uppermost sheet of copying paper is elastically kept in press contact with the paper feed roller 12. When in this state, the paper feed roller 12 is rotated a predetermined amount in the direction of an arrow 16 according to a paper feeding signal, only the uppermost sheet is delivered by the paper feed roller 12.

Usually, in order to prevent a failure of paper feeding or simultaneous feeding of a plurality of paper sheets, the spring constant K of the spring member 10 is set such that in the paper feedable state, the press-contacting pressure under which the uppermost paper sheet is elastically kept in press contact with the paper feed roller 12 by the action of the spring member 10 becomes substantially constant irrespective of the increase or decrease (and therefore, loading or using of copying paper) of the number of copying paper sheets.

This will be described in greater detail. When a predetermined number (for example, 500) of copying paper sheets are placed on the bottom plate 2 of the cassette and the press-contacting mechanism 4 becomes operative, the bottom plate 2 is elastically held in the state shown by a solid line by the press-contacting mechanism 4. When, starting from this state, all of the copying paper sheets on the bottom plate 2 have been used, the bottom plate 2 of the cassette pivots in the direction of arrow 14 and is elastically held in the state shown by a two-dot chain line 2A. Accordingly, in relation to the increase or decrease of the member of copying paper sheets, the bottom plate 2 of the cassette is caused to pivot about its rear end portion as a fulcrum between the state shown by the solid line and the state shown by the two-dot chain line 2A.

On the other hand, when copying paper sheets are placed on the bottom plate 2 of the cassette, the moment M of the copying paper sheets acting on the bottom plate 2 (including the moment of the paper sheets and the moment due to the weight of the bottom plate 2) increases linearly with an increase in the number S of the paper sheets if errors due to changes in the acting direction incident to the pivoting of the bottom plate 2 are neglected. The moment of the copying paper sheets alone is proportional to the number S of the copying paper sheets. Now, the errors due to changes in the acting direction of the moment M of the copying paper sheets incident to the pivoting of the bottom plate 2 will be considered. For example, let us assume that by the use of copying paper sheets, the bottom plate 2 of the cassette has pivoted by an angle $\theta$ in the direction of arrow 14 from its state shown by the solid line (in the substantially horizontal state), the errors due to changes in the acting direction of the moment M of the copying papers is $M(1-\cos\theta)$. It will be readily understood by those skilled in the art that in actual paper feeders, the angle through which the bottom plate 2 is caused to pivot is relatively small, and one can assume $\cos\theta \div 1$, and therefore, the errors due to changes in the acting direction of the moment M of the copying paper sheets can substantially be ignored. Hence, let the moment due to the weight of the bottom plate 2 of the cassette be $M_1$ and the moment of copying paper sheets be $M_2$ when a predetermined number of (for example, 500) copying paper sheets having a relatively small size (for example, JIS A4 are placed on the bottom plate 2 of the cassette. Then, the moment M of the copying paper sheets with regard to the number S of the paper sheets can be regarded as a function which directly increases with an increase in the number S of the paper sheets as shown in FIG. 2-A. Furthermore, let the moment of copying paper sheets be $M_3(M_3 > M_2)$ when a predetermined number of (for example, 500) copying paper sheets having a relatively large size (for example, JIS A-3 size) placed on the bottom plate 2 of the cassette. Then, the moment M of the copying paper sheets with regard to the number S of copying paper sheets can be regarded as a function which directly increases with an increase in the number S of the copying paper sheets as illustrated in FIG. 2-B, and the gradient of the function is larger than in the case of the copying paper sheets having a relatively small size. (It is to be understood that a copying paper cassette on which this cassette bottom plate 2 is to be mounted is of a known structure in which a plurality of types of copying paper sheets having different sizes can be received by moving a rear end restricting member which regulates the rear end portion of copying paper sheets.)

To determine the spring constant K of the spring member 10, we now consider an error due to changes in the pulling direction of the pulling force of the spring member 10 incident to the pivoting of the bottom plate 2, an error due to changes in the pressing direction of the pressing force of the paper feed roller 12 which occurs as a reaction of the press-contacting force by which the uppermost paper sheet is elastically kept in press contact, and an error due to changes in the distance from the contacting portion between the bottom plate 2 and the roller 8 to the rear end portion (in more detail, the center of pivoting of the bottom plate 2) of the bottom plate 2.

The error due to changes in the pulling direction of the pulling force of the spring member 10 can also be substantially ignored, as in the case of the error due to changes in the acting direction of the moment M of the copying paper sheets described above. This is because the pivoting angle of the bottom plate 2 of the cassette is relatively small, and the spring member 10, as shown in FIG. 1, is disposed in a direction substantially midway between the direction shown by arrow A which is perpendicular to the bottom plate 2 (shown by a solid line) on which a predetermined number of (for example, 500) copying paper sheets are placed and the direction shown by arrow B perpendicular to the bottom plate 2 (shown by two-dot chain line 2A) on which no copying paper is placed. As a result, the change in the pulling direction of the pulling force incident to the pivoting of the bottom plate 2 becomes minimum. Accordingly, the pulling direction of the pulling force of the spring 10 can be regarded as a direction opposite to the direction of arrow A which is substantially constant irrespective of the increase or decrease of copying paper sheets.

The error due to changes in the pressing direction of the pressing force of the paper feed roller 12 can also be substantially ignored, as in the case of the error attributed to changes in the acting direction of the moment M of copying paper sheets because the angle of pivoting of the bottom plate 2 of the cassette is relatively small. Hence, the pressing direction of the pressing force of the paper feed roller 12 can be regarded as the direction of arrow A which is substantially constant irrespective of the increase or decrease of the copying paper sheets.

The error due to changes in the distance from the contacting portion between the bottom plate 2 and the roller 8 to the rear end portion of the bottom plate 2 (in more detail, the center of pivoting of the bottom plate 2 of the cassette) can also be substantially ignored, because the angle of pivoting of the bottom plate 2 is relatively small. Hence, the distance from the contacting portion between the bottom plate 2 and the roller 8 to the rear end portion of the bottom plate 2 can be regarded as being substantially constant irrespective of the increase or decrease of the copying paper sheets.

By considering the above items, the spring constant K of the spring member 10 which brings the uppermost copying paper sheet into elastic press contact with the paper feed roller under a substantially constant contact pressure irrespective of the increase or decrease of the number of copying paper sheets is determined by letting the distance from the contacting portion between the bottom plate 2 and the roller 8 to the rear end portion of the bottom plate 2 (it should be understood that one end portion of the spring member 10 is fixed at a site near the contacting portion between the bottom plate 2 and the roller 8 as shown in FIG. 1) be l, and the stroke of the spring member 10 when the bottom plate 2 has been caused to pivot from the state shown by the solid line in FIG. 1 to the state shown by the two-dot chain line in FIG. 1 be L. Then, the spring constant $K_1$ at the time when copying paper sheets of a relatively small size (for example, JIS A4 size) are placed on the bottom plate 2 is defined by the following equation.

$$K_1 = \frac{M_2 - M_1}{l \cdot L}$$

The spring constant $K_2$ at the time when copying paper sheets of a relatively large size (for example JIS A3 size) are placed on the bottom plate is given by the following equation.

$$K_2 = \frac{M_3 - M_1}{l \cdot L}$$

Thus, when copying paper sheets of a relatively small size (for example, JIS A4 size) are to be placed on the bottom plate 2 of the cassette, the aforesaid press-contacting pressure can be maintained substantially constant (an optimal value, for example $P_1$) irrespective of the increase or decrease of copying paper sheets by setting the spring constant K of the spring member 10 at $K=K_1=(M_2-M_1)/l \cdot L$. On the other hand, when sheets of copying paper having a relatively large size (for example, JIS A3 size) are to be placed on the bottom plate 2 of the cassette, the aforesaid press-contacting pressure can be maintained at a substantially constant value (an optimal value, for example $P_1$) irrespective of the increase or decrease of the copying paper sheets by setting the spring constant K of the spring member 10 at $K=K_2=(M_3-M_1)/l \cdot L$.

In an actual copying apparatus, a plurality of types of copying paper cassettes containing sheets of copying paper having different sizes are to be mounted on a cassette-receiving section, but the spring member 10 of the press-contacting mechanism 4 cannot be exchanged, and therefore the spring constant K of the spring member 10 cannot be changed, according to the sizes of the copying paper sheets. Accordingly, when the sizes of the copying paper sheets (therefore their weights with regard to sizes) differ, the press-contacting pressure under which the uppermost copying paper sheet is elastically kept in press contact with the paper feed roller 12, and hence the pressing force of the paper feed roller 12 as a reaction of the press-contacting pressure, varies, and the difference in pressing force makes it impossible to feed the copying paper sheets accurately.

This aspect will be described in detail. For example, when the spring constant K of the spring member 10 of the press-contacting mechanism 4 is set at $K=K_1=(M_2-M_1)/l \cdot L$, the pressing force P of the paper feed roller 12 when sheets of copying paper having a relatively small size (for example, JIS A4 size) are placed on the bottom plate 2 of the cassette becomes an optimal value, i.e. substantially $P=P_1$, irrespective of the increase and decrease of copying paper sheets (loading and using of copying paper sheets) as shown in FIG. 2-C by the solid line, and the copying paper sheets can be fed accurately one by one. But when sheets of copying paper having a relatively large size (for example, JIS A3 size) are placed on the bottom plate 2, the pressing force P of the paper feed roller 12 gradually becomes smaller than $P_1$ (optimal value) in a linear relation with an increase in the number S of copying paper sheets placed on the bottom plate 2 as shown in FIG. 2-C by the broken line, and the excessively small pressing force P causes a failure of paper feeding.

When the spring constant K of the spring member 10 of the press-contacting mechanism 4 is set at $K=K_2=(M_3-M_1)/l\cdot L$, the pressing force P at the time when sheets of copying paper having a relatively large size (for example, JIS A3 size) are placed on the bottom plate 2 of the cassette becomes an optimal value, i.e. substantially $P=P_1$, irrespective of the increase or decrease of the paper sheets as shown in FIG. 2-C by the solid line, and the copying papers can be accurately fed one by one. However, when sheets of copying paper having a relatively small size (for example, JIS A4 size) are placed on the bottom plate 2 of the cassette, the pressing force P gradually becomes larger than $P_1$ (optimal value) in linear relation to an increase in the number S of the copying paper sheets on the bottom plate 2 as shown by the two-dot chain line in FIG. 2-C, and this excessively large pressing force P causes simultaneous feeding of a plurality of paper sheets.

In the present invention, we have noted that when the spring constant K of the spring member 10 of the press-contacting mechanism 4 is set at $K=K_1=(M_2-M_1)/l\cdot L$, the pressing force P of the paper feed roller 12 at the time when sheets of copying paper having a relatively large size (for example, JIS A3 size) are placed gradually becomes smaller as the number S of the copying paper sheets increases. We have therefore maintained the pressing force P at such a time substantially at $P=P_1$ irrespective of the increase or decrease of paper sheets by further stretching the spring member 10 of the press-contacting mechanism 4 gradually in linear relation according to an increase in the number of the paper sheets having a relatively large size (for example, JIS A3 size) on the bottom plate 2 and thereby increasing the press-contacting force of the spring member 10, i.e. the pressing force P of the paper feed roller 12.

Now, there will be examined the amount of compensation of the pressing force P of the paper feed roller 12, and therefore the amount of compensation of the stroke of the spring member 10 of the press-contacting mechanism 4, at the time when sheets of copying paper having a relatively large size (for example, JIS A3 size) are placed on the bottom plate 2 of the cassette. When the pressing force P on a predetermined number of (for example, 500) sheets of copying paper having a relatively large size (for example, JIS A3 size) placed on the bottom plate 2 of the cassette is $P=P_2(P_2<P_1)$, the amount (2) of compensation of the pressing force P for this predetermined number of (for example, 500) paper sheets is $\alpha=(P_1-P_2)$, and the amount (x) of compensation of the stroke of the spring member 10 at this time becomes $x=(P_1-P_2)/K_1$. Hence, the amount ($\alpha_y$) of compensation of the pressing force P for y paper sheets on the bottom plate 2 of the cassette is $\alpha_y=(P_1-P_2)y/500$, and the amount ($x_y$) of compensation of the stroke of the spring member 10 at this time becomes $x_y=(P_1-P_2)y/500K_1$. Accordingly, when the spring constant K of the spring member 10 is set at $K=K_1=(M_2-M_1)/l\cdot L$, the aforesaid pressing force P can be set at an optimal value, i.e. substantially $P=P_1$, irrespective of the increase or decrease of paper sheets even for sheets of copying paper having a relatively large size (for example, JIS A3 size) by setting the amount ($x_y$) of compensation of the stroke of the spring member 10 for y paper sheets of a relatively large size (for example, JIS A3 size) on the bottom plate 2 of the cassette at $x_y=(P_1-P_2)y/500K_1$ (that is, by stretching the spring member 10 further by $x_y$).

The paper feeder of this invention constructed on the basis of the aforesaid principle will be described with reference to FIG. 3. A compensation piece 18 against which the roller 8 of the lever member 6 of the press-contacting mechanism 4 is caused to abut is provided on the lower surface of the bottom plate 2' of the cassette on which sheets of copying paper having a relatively large size (for example, JIS A 3 size) are placed. The compensation piece 18 is formed nearly in a triangular shape in its vertical section so that as the number of paper sheets placed on the bottom plate 2' increases (and hence, as the inclination angle of the bottom plate 2' becomes smaller in FIG. 3), the amount ($\alpha$) of compensation of the press-contacting force on the paper feed roller 12, and therefore the pressing force P of the paper feed roller 12, gradually increase linearly. The roller 8 of the lever member 6 is caused to abut against one inclined surface of its triangular shape. The inclined surface of the compensation piece 18 against which the roller 8 is caused to abut is formed such that the amount ($x_y$) of compensation of the stroke of the spring member 10 by the compensation piece 18 becomes $x_y=(P_1-P_2)y/500K_1$. The shape of the inclined surface of the compensation piece 18 is properly determined according to the weight of paper sheets, the spring constant of the spring member, etc.

Accordingly, in the paper feeder having a paper cassette having mounted thereon the bottom plate 2' including the compensation piece 18, the bottom plate 2' of the cassette is in the state shown by the solid line in FIG. 3 when a predetermined number of (for example, 500) copying paper sheets are placed on the bottom plate 2'. When all the paper sheets on the bottom plate 2' have been used, the bottom plate 2' assumes the state shown by the two-dot chain line 2'A (in which the roller 8 substantially moves away from the compensation piece 18 and abuts against the bottom plate 2'). Thus, when the paper sheets are placed on the bottom plate 2', the roller 8 of the lever member 6 abuts against the inclined surface of the compensation piece 18 and the compensation piece 18 causes stretching of the spring member 10 (not shown in FIG. 3) further as compared with the prior art arrangement which does not include the compensation piece 18, and the press-contacting force on the paper feed roller and hence the pressing force P of the paper feed roller are increased to compensate the pressing force P. Accordingly, even when sheets of copying paper having a relatively large size (for example, JIS A3 size) are placed on the bottom plate 2', the pressing force P can be set at an optimal value, i.e. substantially $P=P_1$, irrespective of the increase or decrease of the paper sheets as in the case of sheets of copying paper having a relatively small size (for example, JIS A4 size). As will be easily understood from the foregoing description, the sheets of copying paper having a relatively small size are placed on the bottom plate 2 having no compensation piece 18.

In short, in the paper feeder of this invention, whether a cassette containing sheets of copying paper having a relatively small size or a cassette containing sheets of copying paper having a relatively large size is mounted on a cassette-receiving section, the pressing force of the paper feed roller can be adjusted to a substantially constant optimal value irrespective of the sizes (hence, weights in relation to sizes) and increase or decrease (hence loading or using) of the number of sheets of copying paper, and the copying paper sheets can be fed accurately one by one.

The above embodiment has been described with regard to the case where the moment on the press-contacting mechanism due to the weight of a cassette bottom plate on which sheets of copying paper having a relatively large size (for example, JIS A3 size) are placed is substantially equal to the moment on the press-contacting mechanism due to the weight of a cassette bottom plate on which sheets of copying paper having a relatively small size (for example, JIS A4 size) are placed. But when the moments due to the weight of the cassette bottom plates on the press-contacting mechanism differ from each other, it is desirable to make the moments due to the weights of the two cassette bottom plates substantially equal to each other by, for example, forming a hole in a portion of the heavier of the bottom plates.

In the above embodiment, the sizes of copying paper sheets to be placed on the bottom plates are JIS A3 and JIS A4 sizes. The invention can also be applied to copying paper sheets having JIS A series sizes and JIS B series sizes.

In the above embodiment, two kinds of copying paper sheets having different sizes are used. The invention, however, is applicable to the use of three or more types of copying paper sheets having different sizes (for example, JIS A3 size, JIS A4 size and JIS A5 size . . . ). In this case, the spring constant of the spring member is set so as to be most suitable for sheets of copying paper having the smallest size (for example, JIS A5 size), and the compensation piece is provided on the back of the bottom plate of the cassette on which sheets of copying paper having a larger size (for example, JIS A4 size, JIS A3 size) are to be placed. Furthermore, the inclination angle of the inclined surface to be contacted with the roller of the compensation piece provided on the bottom plate of the cassette on which to place sheets of copying paper having a relatively large size (for example, JIS A3 size) is made larger than the inclination angle of the inclined surface to te contacted with the roller of the compensation piece provided at the bottom plate of the cassette on which to place sheets of copying paper having a relatively small size.(for example, JIS A4 size).

Now, with reference to FIGS. 4 to 9, a preferred embodiment of the paper feeder constructed on the above principle is described.

Figure 5:
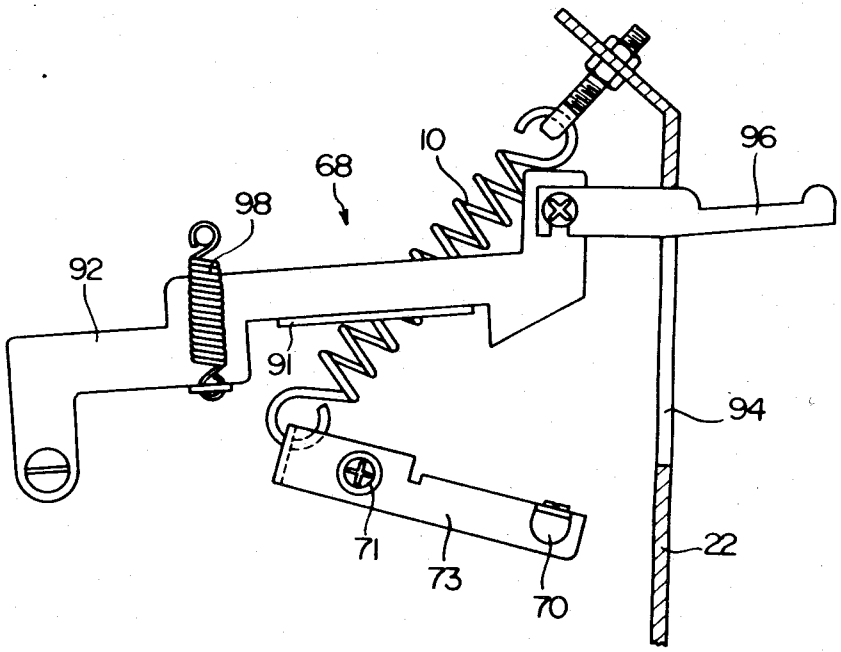
FIG. 5 is a sectional view showing a switching means in the paper feeder constructed in accordance with this invention.
Figure 6:
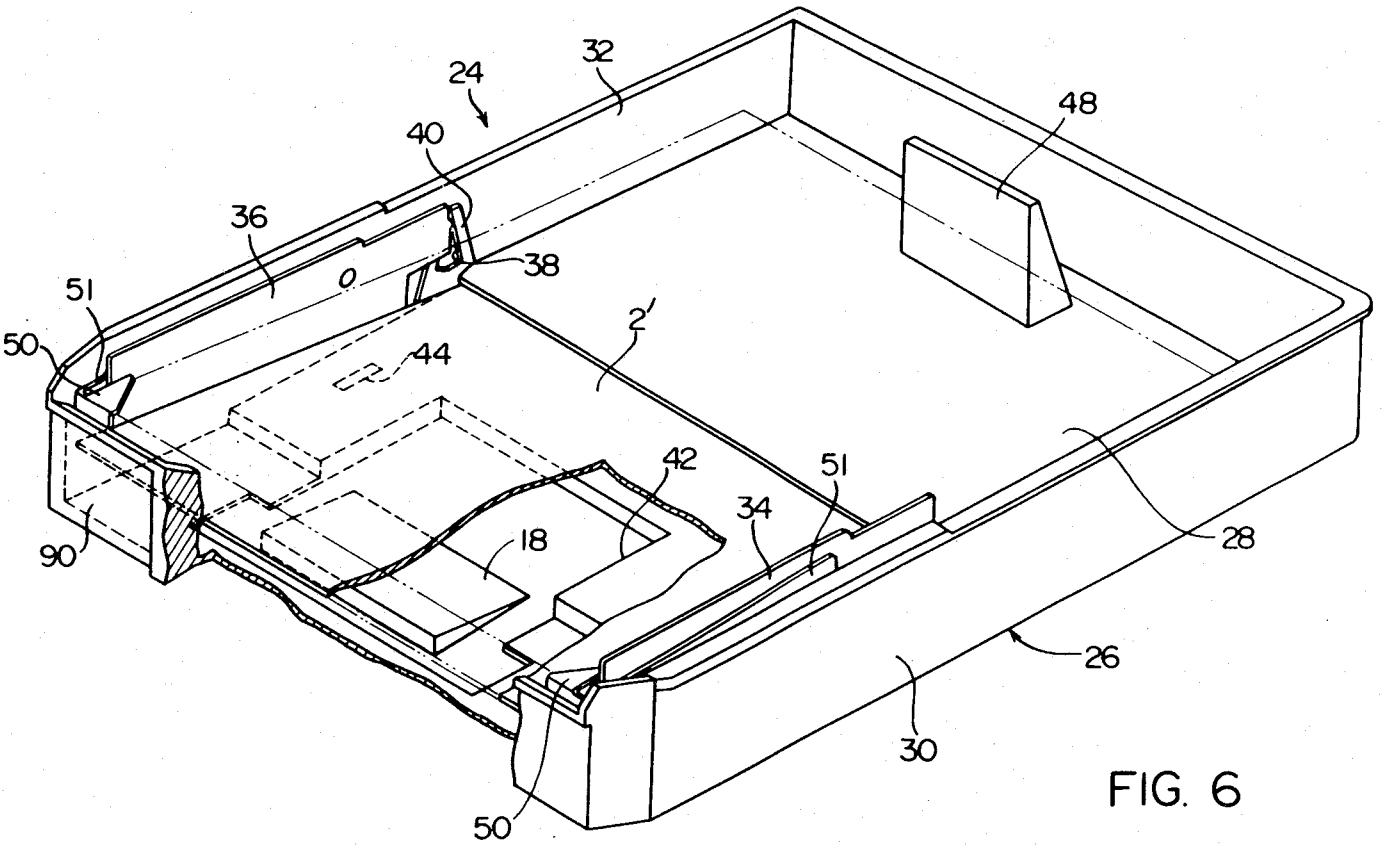
FIG. 6 is a partly broken-away perspective view showing a copying paper cassette in a preferred embodiment of the paper feeder constructed in accordance with principle of this invention.

In FIGS. 4 to 6, the paper feeder equipped with a copying paper cassette has a cassette receiving section 20 located at the upstream end of a copying paper conveying passage (not shown) defined within a housing of a copying apparatus and a copying paper cassette 24 mounted on the cassette receiving section 20 through an opening (not shown) formed in the housing of the copying apparatus.

The paper cassette 24 in the illustrated embodiment has a substantially rectangular main body 26 having an opening at its upper surface, as shown in FIG. 6. At a bottom wall 28 of the main body 26 of the cassette, a right supporting wall 34 and a left supporting wall 36 are fixed to the inside front portions of a right side wall 30 and a left side wall 32, respectively, and a cassette bottom plate 2' is disposed between the right supporting wall 34 and the left supporting wall 36. On the bottom plate 2', upstanding walls 40 (only the left side upstanding wall 40 is shown in the drawing) having a nearly triangular hole 38 are provided at the rear ends of both side ends of the bottom plate 2', and bent portions of the rear end portions of the right supporting wall 34 and the left supporting wall 36 are inserted in the holes 38 of the upstanding walls 40. Hence, in the cassette bottom plate 2', the upstanding walls 40 at both side ends are supported by the right supporting wall 34 and the left supporting wall 36. A compensation piece 18 nearly triangular in vertical section having the structure described hereinabove is provided centrally at the front end portion of the lower surface of the bottom plate 2'. As will be easily understood from the above description, therefore, sheets of copying paper having a relatively large size (for example, JIS A3 size) are accomodated in the main body 26 having the bottom plate 2' mounted thereon. A stepped portion 27 (see FIG. 7) is formed in the front portion of the bottom wall 28 of the main body 26 of the cassette, and a rectangular opening 42 is formed in the bottom wall of the stepped portion 27. Furthermore, slender holes 44 (only one of them is shown in the drawing) are formed on the left and right side portions of the front portion of the bottom wall 28, respectively. Furthermore, a projection 46 (see FIGS. 7-A and 7-B) is provided nearly centrally in the bottom wall 28. Furthermore, an end restricting member 48 for restricting the rear end of sheets of copying paper accomodated in the main body 26 of the cassette is detachably provided centrally at the rear end portion of the bottom wall 28.. As can be easily understood from FIGS. 7-A and 9, when sheets of copying paper having a relatively large size (for example, JIS A3 size) are accomodated in the main body 26 of the cassette, the end restricting member 48 is mounted at the position shown in FIGS. 6 and 7-A (hence, at the rear end portion of the bottom wall 28 of the main body 26 of the cassette). When sheets of copying paper having a relatively small size (for example, JIS A4 size) are to be accomodated in the main body 26 of the cassette, the end restricting member 48 is mounted at the position illustrated in FIG. 9 (hence, at a position substantially centrally of the bottom wall 28 of the main body 26 of the cassette and slightly ahead of the projection 46). An oscillating member 51 having a paper separating claw 50 formed as an integral unit is pivotably mounted on the outside of each of the right supporting wall 34 and the left supporting wall 36. After sheets of copying paper have been accommodated in the main body 26 of the cassette, a cassette closure member (not shown) is mounted on the opening formed in the upper surface of the main body 26.

A cassette bottom plate 2 having no compensation piece 18 formed therein is mounted on the main body 26 of the cassette in which to accomodate sheets of paper having a relatively small size (for example, JIS A4 size), as shown in FIG. 9. In this case, a cut hole 53 for the end restricting member 48 is formed centrally in the rear end portion of the cassette bottom plate 2. Otherwise, the structure of this cassette is substantially the same as the copying paper cassette 24 in which to accomodate sheets of paper having a relatively large size (for example, JIS A3 size).

On the other hand, as shown in FIGS. 4 and 5, the cassette receiving section 20 in the illustrated embodiment is defined between a front vertical base plate 52 and a rear vertical base plate 54 respectively having a cassette top guiding portion **52*a* and a cassette top guiding portion 54*a* formed at the upper ends of these base plates, which base plates are disposed with a predetermined distance therebetween in the front and rear directions in the housing of the copying apparatus. The cassette-receiving section 20 includes a receiving member 56 acting on the forward end portion of the paper cassette 24 inserted through the opening formed in a side wall 22 of the housing. The receiving member 56 fixed between the front vertical base plate 52 and the rear vertical base plate 54 has a cassette bottom guiding portion 56***a* extending substantially horizontally toward the inside of the housing of the copying apparatus, a vertical portion 56*b* extending substantially vertically upwardly from the inside end of the cassette bottom guiding portion 56*a* and a paper guiding portion 56*c* extending further inwardly from the upper end of the vertical portion 56*b*, and an opening 57 is formed centrally at the forward end portion of the cassette bottom guiding portion 56*a*. A copying paper feeding member 58 (see FIG. 7-A) is disposed at a position spaced a predetermined distance upwardly from the cassette bottom guiding portion 56*a* of the receiving member 56. In the illustrated embodiment, the paper feeding member 58 is comprised of a shaft 60 drivingly connected to a drive source through a suitable clutch mechanism (not shown) and selectively rotated, and a roller 62 fixed to the shaft 60.

The housing of the copying apparatus further includes a press-contacting mechanism 4 which acts on the bottom plate 2' of the cassette when it is in an operative condition, means for holding the press-contacting mechanism 4 in the inoperative state, locking means 66 which, when the copying paper cassette 24 has been mounted on the cassette receiving section 20, positions the cassette 24 in place and prevents the cassette 24 from being disengaged from the cassette-receiving section 20, and a switching means 68 for switching the press-contacting mechanism 4 from its operative state to its non-operative state.

The press-contacting mechanism 4, as shown in FIGS. 4 and 7-A, includes a pair of lever members 6 disposed in the front and rear directions in spaced-apart relationship, a roller 8 and a spring member 10. One end of each lever member 6 is secured fixedly to a shaft member 70 located beneath the cassette bottom guiding portion 56*a* of the receiving member 56 and pivotably mounted between the front vertical base plate 52 and the rear vertical base plate 54. An abutting member 69 and a shaft member 72 are fixed between and to the pair of lever members 6, and the roller 8 is rotatably mounted on each of the opposite end portions of the shaft member 72 (the opposite end portions which project side-ways from the lever members 6). To one end of the shaft member 70 projecting from the front vertical base plate 52 is fixed one end of an actuating lever member 73 having an abutting roller 71 formed therein, as shown on an enlarged scale in FIG. 5, and spring member 10 is mounted between the other end portion of the actuating lever member 73 and the side wall 22 of the housing of the copying apparatus. Accordingly, in the above-described press-contacting mechanism 4, the action of the spring 10 causes the lever members 6 to pivot clockwise about the axis of shaft member 70 as a center in FIGS. 4 and 7-A, through the actuating lever member 73 and the shaft member 70.

As shown in FIGS. 4 and 7-A, the holding means 64 has a nearly L-shaped holding lever member 74, and a bifurcated portion at one end portion (rear end portion) of the holding lever member 74 is pivotably mounted through a shaft member 78 between a pair of brackets 76 (only one is shown in the drawing) fixed to the receiving member 56. Inclined surfaces 80 and 82 are formed on the upper and lower surfaces of the forward end of the holding lever member 74, and a projecting portion 84 is formed at its nearly vertical portion. The projecting portion 84 projects into the cassette-receiving section 20 through an opening 86 formed in the vertical portion 56*b* of the receiving member 56. A torsion spring member 88 is further mounted on the shaft member 78, an intermediate portion of the torsion spring member 88 is caused to abut against the receiving member 56, and both end portions of torsion spring member 88 are caused to abut against the holding lever member 74. Hence, with the above-described holding means 64, the action of the torsion spring member 88 causes the holding lever member 74 to pivot counterclockwise about the shaft member 78 as a center in FIGS. 4 and 7-A. When the holding lever member 74 is held at its non-operative position shown in FIG. 8 (at which the forward end portion of the holding lever member 74 abuts against the lower surface of the receiving member 56 by the action of the torsion spring member 88), the shaft member 72 of the press-contacting mechanism 4 is caused to abut against the inclined surface 82 of the holding lever member 74 and the press-contacting mechanism 4 is kept in the inoperative state. On the other hand, when the copying paper cassette 24 is mounted on the cassette receiving section 20 and the holding member 74 is held at its operating position shown in FIGS. 4 and 7.A (at which the holding lever member 74 is pivoted slightly clockwise by the front wall 90 of the main body 26 of the cassette), the abutting of the shaft member 72 of the press-contacting mechanism 4 against the inclined surface 82 of the holding lever member 74 is released, and the press-contacting mechanism 4 becomes operative.

As shown on an enlarged scale in FIG. 5, the switching means 68 has an operating lever 92 having formed therein a bent portion 91 capable of abutting against the abutting roller 71 of the actuating lever 73 of the press-contacting mechanism 4, and one end portion of this operating lever member 92 is pivotably mounted on the front vertical base plate 52. To the other end of the operating lever 92 is fixed an operating member 96 projecting outwardly through a slender opening 94 formed in the side wall 22. A spring member 98 is disposed between the operating lever member 92 and the front vertical base plate 52. Accordingly, with the aforesaid switching means 68, the action of the spring member 98 causes the operating lever member 92 to pivot counterclockwise in FIGS. 4 and 5. When in the operative state of the press-contacting mechanism, the operating member 96 is depressed by hand to pivot the operating lever member 92 cloclwise against the force of the spring member 98, the bent portion 91 of the operating lever member 92 abuts against the abutting roller 71 of the actuating lever member 73 to pivot the actuating lever 73, and therefore the lever member 6, counterclockwise in FIGS. 4 and 7-A. Thus, the press-contacting mechanism 4 is held in the inoperative state wherein the shaft member 72 abuts against the inclined surface 82 of the holding lever member 74.

The locking means 66 has a pair of engaging lever members 100 extending at both lower side portions of the receiving member 56. Each engaging lever member 100 is pivotably mounted through a shaft member 104 on a bracket 102 one end of which is provided at the receiving member 56. An engaging claw portion 106 (only one is shown in FIG. 4) is formed at the other end of the engaging lever member 100. A linking member 110 is fixed between and to the pair of engaging lever members 100. The linking member 110 has formed therein a bent portion 112 capable of abutting against the abutting plate 69 fixed between and to the lever members 6 of the press-contacting mechanism 4. Torsion spring members 114 (only one is shown in the drawing) are mounted on the shaft member 104, and one end of each torsion spring member 114 is caused to abut against the receiving member 56, and its other end is engaged with a part of each of the engaging lever members 100. Hence, with the locking means 66, the action of the torsion spring members 114 causes the pair of engaging lever members 100 together with the linking member 110 to pivot counterclockwise in FIGS. 4 and 7-A. When the copying paper cassette 24 is mounted on the cassette-receiving section 20 and the press-contacting mechainsm 4 becomes operative, the pair of engaging lever members 100 are kept in engagement as shown in FIG. 7-A, and the forward end portions of the engaging lever members 100 abut against the lower surface of the cassette bottom guiding portion 56*a* of the receiving member 56. Each engaging claw portion 106 is thus brought into engagement with the side surface of the slender hole 44 formed in the bottom wall 28 of the main body 26 of the cassette through an opening 116 (only one is shown) formed in the cassette bottom guiding portion 56*a*. On the other hand, when the switching means 68 is actuated to maintain the press-contacting mechanism 4 inoperative, the linking member 110, and therefore the engaging lever members 100, are pivoted clockwise in FIGS. 4 and 7-A by the abutting plate 69 of the lever members 6 of the press-contacting mechanism 4 against the force of the spring members 114. As a result, the engaging lever members 100 are kept out of engagement (see FIG. 8), and the engagement between the engaging claw portions 106 and the holes 44 of the main body 26 of the cassette is released.

In the illustrated paper feeder, a plate spring member 118, which abuts against the front wall 90 of the main body 26 of the copying paper cassette 24 when the cassette 24 has been mounted on the cassette-receiving section 20, is further provided in the front vertical base plate 52 and the rear vertical plate 54.

The operation and result of the paper feeder equipped with the copying paper cassette having the structure described above will be described.

To mount on the cassette receiving section 20 the copying paper cassette 24 having sheets of copying paper of a relatively large size (for example, JIS A3 size) accomodated therein and therefore having mounted thereon the bottom plate 2' with the compensation piece 18, the front portion of the cassette 24 is put in the housing of the copying apparatus (in detail, between the cassette top guiding portions 52*a* and 54*a* of the front vertical base plate 52 and the rear vertical base plate 54 and the cassette bottom guiding portion 56*a* of the receiving member 56) through the opening (not shown) formed in the housing, and the cassette 24 is inserted to the desired position while keeping its bottom surface in contact with the cassette bottom guiding portion 56*a* of the receiving member 56. When the cassette 24 is so inserted, the front wall 90 of the paper cassette 24 is caused to abut against the projecting portion 84 of the holding lever 74 as shown in FIG. 7-A, and the holding lever member 74 is slightly pivoted clockwise in FIGS. 4 and 7-A against the force of the torsion spring member 88 and is held at its operating position. When the holding lever member 74 is held at its operating position, the abutting of the shaft member 72 of the press-contacting mechanism 4 against the inclined surface 82 of the holding lever member 74 is released and the press-contacting mechanism 4 becomes operative. When the press-contacting mechanism is thus made operative, the action of the spring member 10 causes the lever members 6 to pivot clockwise in FIGS. 4 and 7-A about the shaft member 70 as a center through the actuating lever member 73 and the spring member 10. Furthermore, the rollers 8 mounted on the lever members 6 abut against the compensation piece 18 provided in the bottom plate 2' of the cassette through the opening 57 formed in the receiving member 56 and the opening 42 formed in the bottom wall of the cassette 24 to urge the forward end portion of the bottom plate 2' of the cassette upwardly. Thus, the bottom plate 2' of the cassette is pivoted about its rear end portion (in detail, a part abutting against the projecting portion 46 formed in the main body 26 of the cassette) as a fulcrum, and the copying papers stacked on the bottom plate 2' are maintained in a feedable condition in which the uppermost sheet of paper is elastically press-contacted with roller 62 constituting the paper feeding member 58. Simultaneously with this, the pair of engaging lever members 100 change from their non-engaged state to their engaged state shown in FIG. 7-A as a result of releasing the abutting of the bent portion 112 of the linking member 110 against the abutting plate 69 of the lever members 6. Thus, by the action of the torsion spring members 114, the forward end portions of the engaging lever members 100 are caused to abut against the lower surface of the cassette bottom guiding portion 56*a* of the receiving member 56, and engaging claw portions 106 are engaged with the side surface of the holes 44 formed in the bottom wall 28 of the cassette 24 through the openings 116 formed in the receiving member 56. As a result, the paper cassette 24 is held at a predetermined position of the cassette-receiving section 20, and is never disengaged from the cassette receiving section 20.

After the paper cassette 24 has been mounted as above, the bottom plate 2' of the cassette is pivoted clockwise in FIG. 7-A about its rear end portion (that portion which is in abutment against the projection 46 of the bottom wall 28) with the delivery (decrease) of the copying paper, and the rollers 8 are is moved along the inclined surface of the compensation piece 18 of the bottom plate 2' of the cassette. When all of the sheets of paper on the bottom plate 2' have been used, the bottom plate 2' is caused to abut against the roller 62 as shown in FIG. 7-B, and the rollers 8 substantially move away from the inclined surface of the compensation piece 18 and are caused to abut against the bottom plate 2' of the cassette (therefore, the amount of compensation by the compensation piece becomes substantially zero).

In the present embodiment, immediately before the copying paper cassette 24 is inserted to the predetermined position, both end portions of the front wall 90 of the cassette 24 abut against the plate spring member 118 and are inserted to a predetermined position against the force of the plate spring member 118. Accordingly, when the insertion of the copying paper cassette 24 is incomplete, the cassette 24 is pushed back by the action of the plate spring 118 (moved to the right in FIG. 7-A), and therefore, the cassette 24 is prevented from being mounted in an incompletely condition. When the copying paper cassette 24 is mounted at the predetermined position, the action of the plate spring member 118 makes more certain the engagement of the engaging claw portions 106 of the engaging lever members 100 with the side surfaces of the holes 44 of the cassette 24.

On the other hand, to detach the paper cassette 24 from the cassette-receiving section, the operating member 96 is depressed by hand to pivot the operating lever member 92 and then the cassette 24 is withdrawn from the housing of the copying apparatus.

When the operating member 96 is depressed by hand to pivot the operating lever member 92 clockwise in FIGS. 4 and 5, the bent portion 91 of the operating lever member 92 abuts against the abutting roller 71 of the actuating lever member 73, and the actuating lever member 73, and therefore the lever members 6, are pivoted counterclockwise in FIGS. 4 and 7-A. When the lever members 6 are pivoted, the abutting plate 69 abuts against the bent portion 112 of the linking member 110 to pivot the pair of engaging lever members 100 clockwise in FIGS. 4 and 7-A. Furthermore, when the pair of engaging lever members 100 are pivoted together with the lever members 6 to bring the rollers 8 of the lever members 6 to a position outside the paper cassette 24 and to release the engagement of the engaging claw portions 106 of the engaging lever members 100 from the side surfaces of the holes 44 of the cassette 24, the cassette 24 is slightly pushed out from the predetermined position (moved to the right in FIG. 7-A) by the action of the plate spring member 118 and the holding lever member 74 and assumes the state shown in FIG. 8. At this time, the abutting of the projecting portion 84 of the holding lever member 74 against the front wall 90 of the cassette 24 is released and the holding lever member 74 is pivoted counterclockwise in FIGS. 4 and 7-A by the action of the torsion spring member 88, thereby holding the holding lever member 74 temporarily at its non-operating position at which its forward end portion abuts against the lower surface of the receiving member 56. When from this condition the operating lever member 92 is further pivoted to pivot the lever members 6 counterclockwise and the engaging lever members 100 clockwise, the shaft member 72 of the lever members 6 abuts against the inclined surface 80 of the holding lever member 74, and the holding lever member 74 is pivoted clockwise in FIGS. 4 and 7-A. Thereafter, the shaft member 72 of the lever members 6 abuts against the inclined surface 82 of the holding lever member 74, and the holding lever member 74 is pivoted counterclockwise in FIGS. 4 and 7-A. As a result, the holding lever member 74 is again held at its non-operative position at which its forward end portion abuts against the lower surface of the receiving member 56. When the holding lever member 74 is thus held at its non-operative position, the press-contacting mechanism 4 is held in the non-operative state as shown in FIG. 8, and at the same time, the engaging lever members 100 are also kept in the non-operative state. Thereafter, the copying paper cassette 24 in the slightly pulled out state (shown in FIG. 8) from its predetermined position can be withdrawn from the housing of the copying apparatus. After pivoting, the operating lever member 92 is returned to its original state by the action of the spring member 98.

Although the foregoing description has been directed to the mounting and detaching of the copying paper cassette 24 containing sheets of copying paper having a relatively large size (for example, JIS A3 size), substantially the same operation as above can be applied to the mounting and detaching of the copying paper cassette 24 containing sheets of copying paper having a relatively small size (for example, JIS A4 size). In the latter case, however, the rollers 8 of the press-contacting mechanism 4 are caused to abut against the forward end portion of the bottom plate 2 (having no compensation piece 18 provided therein) mounted on the cassette 24, as shown in FIG. 9.

As can be easily understood from the above description and FIGS. 7-A and 8, when the paper cassette 24 is mounted at a predetermined position in the housing of the copying apparatus, the bottom plate 2 or 2' of the cassette is pivotably supported with its rear end portion (that portion which abuts against the projection 46 of the cassette 24) as a fulcrum. When the cassette 24 is not mounted on the aforesaid predetermined position, the bottom plate 2 or 2' of the cassette is caused to abut at its nearly central portion against the stepped portion 27 formed in the front portion of the cassette 24 owing to its own weight. At the same time, the side surfaces of the holes 38 formed in the upstanding walls 40 at the rear end portion abut against the right supporting wall 34 and the left supporting wall 36 and is thus held.

Since in the embodiments illustrated in FIGS. 4 to 9, the compensation piece 18 is provided in the bottom plate 2' of the cassette as stated hereinabove, the pressing force of the paper feed roller can be maintained substantially constant irrespective of the increase or decrease the number of sheets of copying paper (loading or using of sheets of copying paper ) both when the copying paper cassette 24 containing sheets of paper having a relatively small size (for example, JIS A4 size) is mounted on the cassette receiving section 20 and when the copying paper cassette 24 contacting sheets of paper having a relatively large size (for example, JIS A3 size) is mounted on the cassette-receiving section 20.

While the present invention has been described in detail hereinabove with regard to the preferred embodiments of electrostatic copying apparatus improved in accordance with this invention taken in conjunction with the accompanying drawings, it should be understood that the present invention is not limited to these specific embodiments, and various changes and modifications are possible without departing from the scope of the present invention.

What is claimed is:

1. In a paper feeder apparatus of a copying machine and of the type including a cassette-receiving section within a housing of the copying machine, a plurality of copying paper cassettes selectively alternately insertable into said cassette-receiving section, each said cassette being constructed to contain therein a plurality of copying paper sheets of a size different from the size of copying paper sheets in other said cassettes, each said cassette including a main body having a bottom wall with an opening in a forward end portion thereof and a bottom plate mounted on said bottom wall of said main body and pivotable with respect thereto about a rear end portion as a fulcrum, the respective said plurality of copying paper sheets being stacked on said bottom plate, a paper feeding member positioned to confront an uppermost copying paper sheet of a respective said cassette inserted into said cassette-receiving section, and press-contacting means mounted on the housing for extending through said opening in said bottom wall of said main body of the respective said cassette inserted into said cassette-receiving section and contacting said bottom plate thereof and urging said bottom plate to pivot upwardly about said fulcrum and for thereby elastically pressing the uppermost copying paper sheet against said paper feeding member, whereby different moments due to the different weights of said pluralities of different size copying paper sheets in the respective said cassettes act downwardly against the urging force of said press-contacting means, thereby tending to result in the application of different contact pressures of the uppermost copying paper sheets of the respective said cassettes against said paper feeding member, the improvement comprising means for overcoming such tendency and for ensuring that the contact pressure exerted on said paper feeding member by the uppermost copying paper sheet of a respective said cassette containing relatively large size copying paper sheets substantially is equal to the contact pressure exerted on said paper feeding member by the uppermost copying paper sheet of a respective said cassette containing relatively small size copying paper sheets, said means comprising:

said bottom plate of at least said cassette containing said relatively large size copying paper sheets having integral therewith and extending downwardly therefrom a compensation member located at a position to be contacted by said press-contacting means, thereby pivoting said bottom plate upwardly by an extent to compensate for said different moments.

2. The improvement claimed in claim 1, wherein said compensation member includes a surface inclined to the plane of said bottom plate, and said press-contacting means contacts said surface at positions gradually spaced closer to said bottom plate as the copying paper sheets in the respective said cassette are fed therefrom by said paper feeding member.

3. The improvement claimed in claim 2, wherein said surface is positioned such that when all of the copying paper sheets have been fed from said respective cassette, said press-contacting means contact said bottom plate.

4. The improvement claimed in claim 1, wherein said bottom plate of said cassette containing relatively small size copying paper sheets is contacted directly by said press-contacting means.

5. The improvement claimed in claim 1, wherein the moment due to the weight of said bottom plate of said cassette containing said relatively large size copying paper sheets substantially is equal to the moment due to the weight of said bottom plate of said cassette containing said relatively small size copying paper sheets.

* * * * *